US006328578B1

(12) United States Patent
Gilliland et al.

(10) Patent No.: US 6,328,578 B1
(45) Date of Patent: Dec. 11, 2001

(54) HIGH FREQUENCY ELECTROMAGNETIC GROUNDING AND SHIELDING PLATE FOR ELECTRICAL CONNECTORS

(75) Inventors: Don Alan Gilliland; Daniel F. Jones, both of Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/390,739

(22) Filed: Sep. 7, 1999

(51) Int. Cl.[7] ..... H01R 13/648; H01R 9/03
(52) U.S. Cl. ..... 439/95; 439/939; 439/610
(58) Field of Search ..... 439/95, 92, 939, 439/578, 610, 607; 174/66, 67; 220/241, 242

(56) References Cited

U.S. PATENT DOCUMENTS 4,386,814 * 6/1983 Asick ..... 439/607
5,317,105 * 5/1994 Weber ..... 174/35 GC
5,997,349 * 12/1999 Yoshioka ..... 439/579

* cited by examiner

*Primary Examiner*—Paula Bradley
*Assistant Examiner*—Edwin A. León
(74) *Attorney, Agent, or Firm*—Bracewell & Patterson LLP

(57) ABSTRACT

An electromagnetic grounding plate has a central hole with a set of splines that extend radially inward toward the center of the hole. The plate is mounted between a housing and a receptacle connector such that the hole coaxially aligns with an aperture in the housing. A mating connector for the receptacle connector has an outer sleeve and a set of contact pins inside the sleeve. The mating connector is inserted through the aperture in the housing and into engagement with the receptacle connector. As the sleeve of the mating connector contacts the splines on the plate, the splines deflect slightly inward toward the receptacle connector. The contact between the sleeve and the splines establishes a radio frequency (RF) contact between the mating connector and the housing to ground high frequency electromagnetic emissions.

16 Claims, 2 Drawing Sheets

HIGH FREQUENCY ELECTROMAGNETIC GROUNDING AND SHIELDING PLATE FOR ELECTRICAL CONNECTORS

BACKGROUND OF THE INVENTION

1. Technical Field

This invention relates in general to grounding electrical connector emissions, and in particular to an apparatus and method for grounding high frequency, electromagnetic emissions at electrical connector interfaces.

2. Background Art

Controlling electromagnetic (EM) emissions of computing systems by shielding or grounding the hardware, connectors and the like is well known in the art. One problem with conventional connectors is that they have a limited range of operational frequency support. Some connector types such as PCI connectors or DIN connectors for the keyboard and mouse only support frequencies up to about 400 MHZ. However, as systems continue to improve, frequencies of 1 GHz or more are becoming commonplace. If left unchecked, these higher frequencies can emit excessive amounts of EM interference. This problem is particularly acute with existing or older systems that have been upgraded to run at higher speeds. These systems were not designed to operate at such levels and are incapable of grounding the associated EM emissions. Thus, a solution is needed to ground inadequately insulated equipment, particularly at the connector interfaces.

SUMMARY OF THE INVENTION

An electromagnetic grounding plate has a central hole with a set of splines that extend radially inward toward the center of the hole. The plate is mounted between a housing and a receptacle connector such that the hole coaxially aligns with an aperture in the housing. A mating connector for the receptacle connector has an outer sleeve and a set of contact pins inside the sleeve.

The mating connector is inserted through the aperture in the housing and into engagement with the receptacle connector. As the sleeve of the mating connector contacts the splines on the plate, the splines deflect slightly inward toward the receptacle connector. The contact between the sleeve and the splines establishes a radio frequency (RF) contact between the mating connector and the housing to ground high frequency electromagnetic emissions.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

BEST MODE FOR CARRYING OUT THE INVENTION

Figure 1:
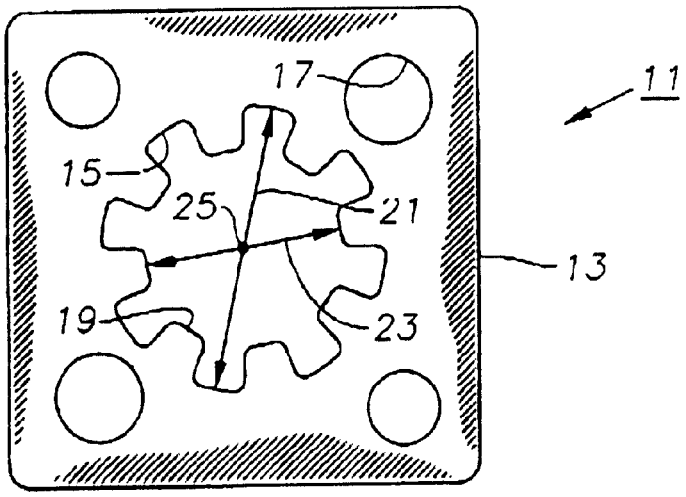
FIG. 1 is an enlarged plan view of a grounding device constructed in accordance with the invention.

Referring to FIG. 1, an electromagnetic shielding and grounding device 11 is shown. Device 11 comprises a substantially thin, flat plate 13 having a central opening 15 and a plurality of mounting holes 17. Opening 15 has a plurality of symmetrically arrayed, coplanar wiping members or splines 19 that protrude inward from its perimeter. In the particular embodiment shown, plate 13 is square in shape, has eight splines 19, and has a mounting hole 17 near each of its corners. Opening 15 is circular and defined by a major diameter 21 and a minor diameter 23 extending between the inner edges of opposed ones of the generally square splines 19. Splines 19 extend radially inward from opening 15 toward a center point 25.

Figure 2:
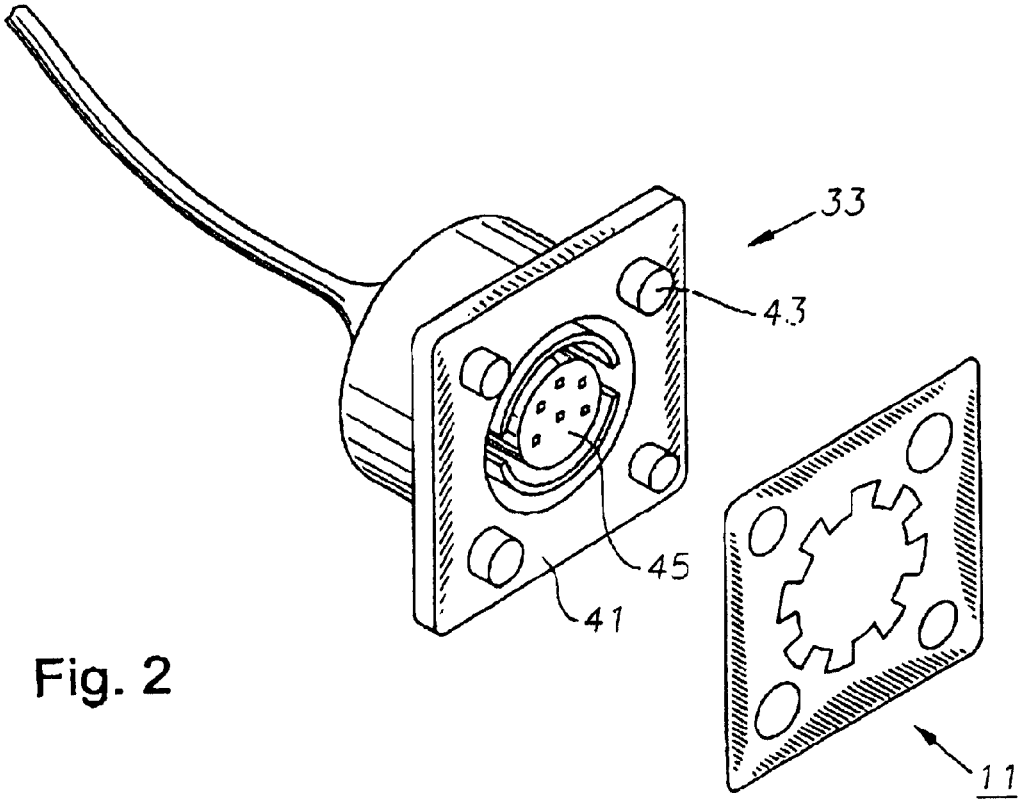
FIG. 2 is a schematic isometric drawing of sample connectors with which the grounding device of FIG. 1 may be used.
Figure 3:
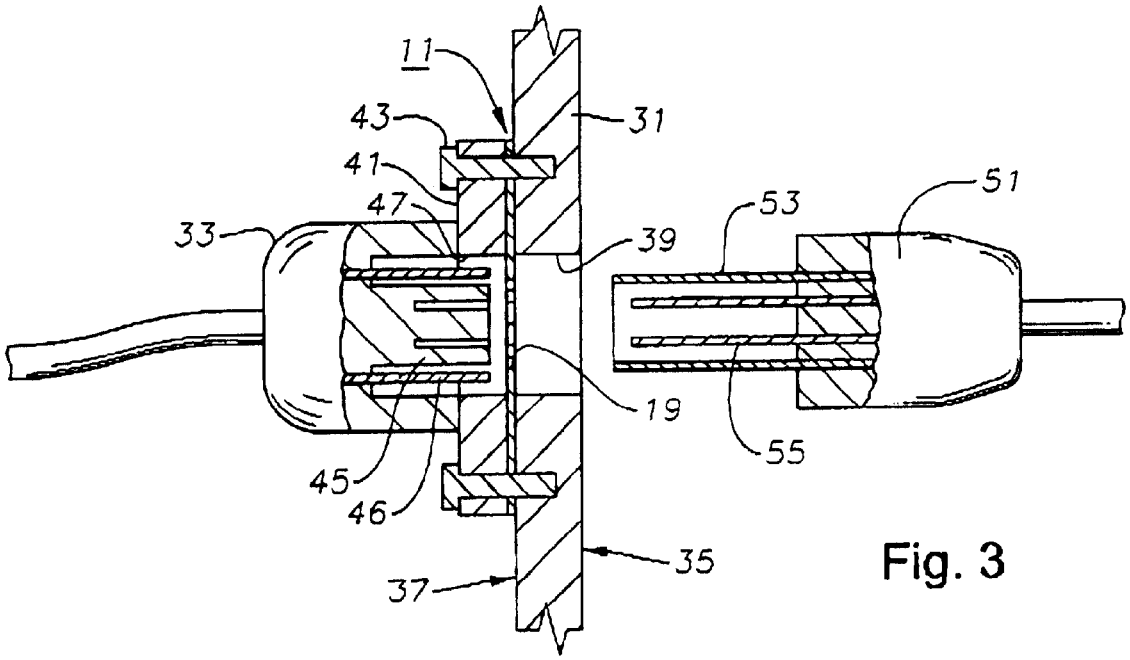
FIG. 3 is a sectional side view of the grounding device of FIG. 1 installed with a connector receptacle prior to insertion of the mating socket.

As shown in FIGS. 2 and 3, device 11 is designed to be mounted between a system enclosure or housing 31 and a receptacle connector 33. Device 11 could also be a permanent fixture of housing 31. Housing 31 has an outer surface 35, an inner surface 37, and an aperture 39 extending therebetween. Device 11 is mounted flat against the inner surface 37 such that opening 15 is coaxial with aperture 39. Device 11 and/or connector 33 could also be mounted on the exterior surface 35. A backplate 41 on connector 33 abuts the opposite side of device 11 and a plurality of screws 43 extend through backplate 41 and mounting holes 17 in device 11 to secure the assembly to housing 31.

Connector 33 is conventional and may comprise a PCI or DIN-type connector having a solid cylindrical hub 45 with a plurality of pin holes and an outer ground sleeve 46. In the embodiment shown, hub 45 partially extends through a central hole 47 in plate 41. A mating connector 51 for connector 33 is shown on the right side of FIG. 3. Connector 51 has a cylindrical ground shield or sleeve 53 and a plurality of internal signal contact pins 55 located inside sleeve 53.

Figure 4:
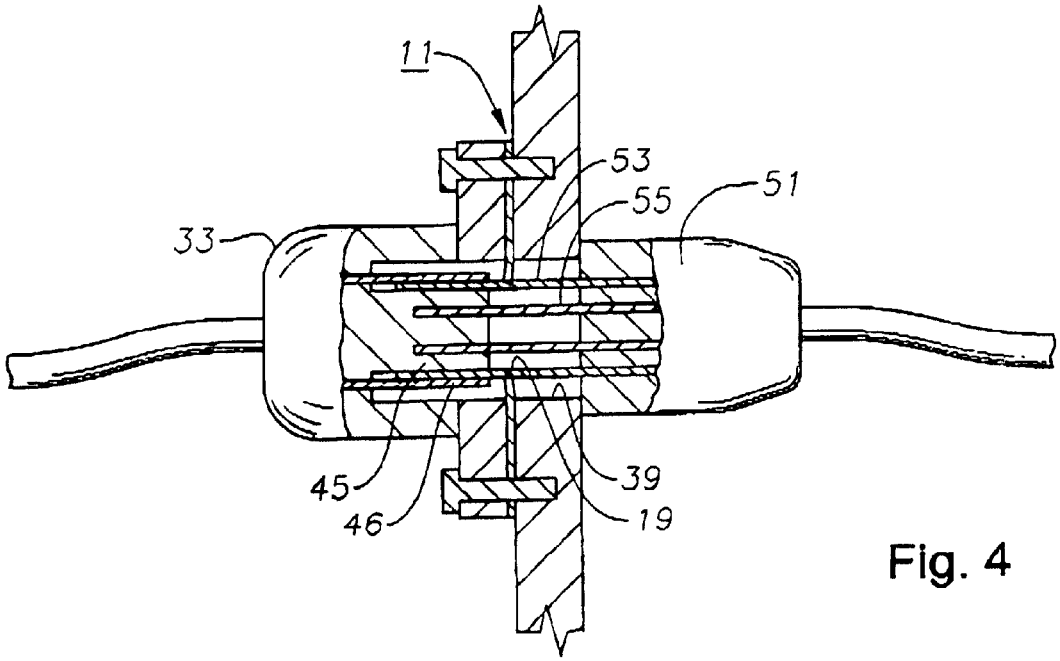
FIG. 4 is a sectional side view of the grounding device, receptacle, and socket of FIG. 3 after insertion.

In operation (FIG. 4), connector 51 is inserted into aperture 39 in housing 31 and into engagement with connector 33. The outer diameter of sleeve 53 is smaller than the inner diameter of aperture 39. The inner diameter of sleeve 53 engages sleeve 46 and closely receives the outer diameter of hub 45 in connector 33. Pins 55 simultaneously insert into the pin holes in hub 45. The minor diameter 23 (FIG. 1) of device 11 is slightly smaller than the diameters of aperture 39 in housing 31 and hole 47 in backplate 41. Note also that the outer diameter of sleeve 53 is slightly greater than minor diameter 23. In one embodiment, these diameters differ by approximately 0.001 in to ensure reliable contact but avoid excessive retention force. As connector 51 contacts the splines 19 of device 11 and is pushed into connector 33, splines 19 deflect slightly inward a slight amount (about one to three degrees) toward connector 33 (FIG. 4). The contact between sleeve 53 and device 11 establishes a radio frequency (RF) contact between connector 51 and housing 31. Splines 19 wipe against sleeve 53 and provide a low RF impedance path to housing 31.

Alternatively, splines 19 of device 11 could be permanent contact with sleeve 46 of connector 33. In this version, splines 19 do not contact sleeve 53 directly, rather they maintain electrical contact with sleeve 46 and ground connector 51 when its sleeve 53 engages sleeve 46. In either case, although connectors 33, 51 normally would be limited to grounding electromagnetic emissions for operational frequencies of less than 400 MHZ, device 11 enhances their grounding capability to 1 to 3 GHz.

The invention has several advantages. The grounding plate expands allows DIN-type connectors to operate at frequencies in excess of 1 GHz, thus expanding their frequency range of operation. The solution allows a very low cost connector to be improved to function at high frequencies with minimal cost. Even antiquated connectors can be upgraded to meet modern emissivity requirements with this invention.

While the invention has been shown or described in only some of its forms, it should be apparent to those skilled in the art that it is not so limited, but is susceptible to various changes without departing from the scope of the invention.

We claim:

1. An electrical apparatus, comprising in combination:

a housing having an aperture with a center point;

a grounding device mounted to the housing adjacent to the aperture and having a wiping member extending therefrom generally toward the center point of the aperture;

an electrical first connector mounted to the housing and having a ground shield, a signal contact, and an axis that generally aligns with the center point of the aperture;

an electrical second connector extending through the aperture and having a ground shield and a signal contact that engage those of the first connector, respectively, such that the wiping member on the grounding device contacts one of the ground shields of the first and second connectors in order to ground high frequency electromagnetic emissions between the first and second connectors; and wherein the grounding device grounds emissions in the frequency range of in excess of 0.4 Ghz and up to 3.0 GHz.

2. The electrical apparatus of claim 1 wherein the grounding device is a plate with an opening and the wiping member extends inward from the opening.

3. The electrical apparatus of claim 1 wherein the ground shield of the second connector contacts the wiping member of the grounding device and deflects it toward the first connector.

4. The electrical apparatus of claim 1 wherein the grounding device is located between the housing and the first connector.

5. The electrical apparatus of claim 1 wherein the wiping member comprises a plurality of elements that wipe on an exterior surface of said one of the ground shields.

6. The electrical apparatus of claim 1 wherein the wiping member is a set of symmetrically spaced apart splines.

7. An electrical apparatus, comprising in combination:

a housing having an aperture with a center point;

a grounding device mounted to the housing and having an opening with a perimeter, a center point, and a plurality of wiping members extending radially inward from the perimeter generally toward the center point, wherein the center point of the opening is aligned with the center point of the aperture;

an electrical first connector mounted to the housing and having a ground shield, signal contacts, and an axis that aligns with the center points of the aperture and opening;

an electrical second connector extending through the aperture and having a ground shield and signal contacts that engage those of the first connector, respectively, such that the wiping members on the grounding device contact one of the ground shields of the first and second connectors to ground high frequency electromagnetic emissions between the first and second connectors; wherein the wiping members are generally coplanar prior to deflection and bent toward one of the first and second connectors after deflection; and wherein the grounding device is capable of grounding emissions in the frequency range of in excess of 0.4 GHz and up to 3.0 GHz.

8. The electrical apparatus of claim 7 wherein the grounding device is a thin plate, the opening in the plate is circular with a circumference, and the wiping members extend symmetrically and radially inward from the circumference.

9. The electrical apparatus of claim 7 wherein the wiping members contact the ground shield of the second connector and are deflected toward the first connector generally about the perimeter of the opening in the grounding device.

10. The electrical apparatus of claim 7 wherein the connectors are DIN-type connectors.

11. An electrical apparatus, comprising in combination:

a housing having an aperture with a center point:

a grounding device mounted to the housing and having an opening with a perimeter, a center point, and a plurality of wiping members extending from the perimeter generally toward the center point, wherein the center point of the opening is aligned with the center point of the aperture;

an electrical first connector mounted to the housing and having a ground shield, signal contacts, and an axis that aligns with the center points of the aperture and opening;

an electrical second connector extending through the aperture and having a ground shield and signal contacts that engage those of the first connector, respectively, such that the wiping members on the grounding device contact one of the ground shields of the first and second connectors to ground high frequency electromagnetic emissions between the first and second connectors; and wherein the wiping members are deflected approximately one to three degrees relative to the grounding device.

12. The electrical apparatus of claim 7 wherein the grounding device is located between the housing and the first connector.

13. An electrical apparatus, comprising in combination:

a housing having an aperture with a center point;

a grounding device mounted to the housing and having an opening with a perimeter, a center point, and a plurality of wiping members extending from the perimeter generally toward the center point, wherein the center point of the opening is aligned with the center point of the aperture;

an electrical first connector mounted to the housing and having a ground shield, signal contacts, and an axis that aligns with the center points of the aperture and opening;

an electrical second connector extending through the aperture and having a ground shield and signal contacts that engage those of the first connector, respectively, such that the wiping members on the grounding device contact one of the ground shields of the first and second connectors to ground high frequency electromagnetic emissions between the first and second connectors; and wherein inner edges of the wiping members are separated by a distance that is approximately 0.001 inches less than an outer dimension of said one of the ground shields.

14. The electrical apparatus of claim 7 wherein the wiping members are generally rectangular splines.

15. In an electrical apparatus having a housing with an inner surface, an outer surface, and an aperture extending therethrough with a center point, an electrical interface comprising:

an electrical first connector mounted to the inner surface of the housing and having a ground shield, signal contacts, and an axis that aligns with the center point of the aperture;

a ground plate mounted between the first connector and the inner surface of the housing, the ground plate having an opening with a center point, and a plurality of generally coplanar, symmetrically spaced apart splines extending radially inward from the opening toward the center point, wherein the center point of the opening is aligned with the center points of the aperture and the axis of the first connector;

an electrical second connector extending through the aperture and having a ground shield and signal contacts that engage those of the first connector, respectively, such that the wiping members on the ground plate contact the ground shield of the second connector to ground high frequency electromagnetic emissions at the interface between the first and second connectors; and wherein the ground plate is capable of grounding emissions in the frequency range of in excess of 0.4 Ghz and up to 3.0 GHz.

16. In an electrical apparatus having a housing with an inner surface, an outer surface, and an aperture extending therethrough with a center point, an electrical interface comprising:

an electrical first connector mounted to the inner surface of the housing and having a ground shield, signal contacts, and an axis that aligns with the center point of the aperture;

a ground plate mounted between the first connector and the inner surface of the housing, the ground plate having an opening with a center point, and a plurality of generally coplanar, symmetrically spaced apart splines extending from the opening toward the center point, wherein the center point of the opening is aligned with the center points of the aperture and the axis of the first connector;

an electrical second connector extending through the aperture and having a ground shield and signal contacts that engage those of the first connector, respectively, such that the wiping members on the ground plate contact the ground shield of the second connector to ground high frequency electromagnetic emissions at the interface between the first and second connectors; and wherein inner edges of the splines are separated by a distance that is approximately 0.001 inches less than an outer dimension of the ground shield of the second connector.

* * * * *